United States Patent [19]

Selwood

[11] 3,978,267

[45] Aug. 31, 1976

[54] COMPACT TWISTLESS TEXTILE YARN COMPRISING DISCONTINUOUS FIBER BONDED BY POTENTIALLY ADHESIVE COMPOSITE FIBERS

[75] Inventor: Alan Selwood, Newport, England

[73] Assignee: Imperial Chemical Industries Limited, London, England

[22] Filed: Feb. 24, 1975

[21] Appl. No.: 552,264

Related U.S. Application Data

[60] Continuation of Ser. No. 357,576, May 7, 1973, abandoned, Division of Ser. No. 141,713, May 10, 1971, Pat. No. 3,745,757.

[30] Foreign Application Priority Data

May 20, 1970 United Kingdom ..... 24421/70

[52] U.S. Cl. ..... 428/360; 428/364; 428/374; 428/375; 428/392; 428/394; 428/395

[51] Int. Cl. ..... B32B 27/00; D02G 3/00; B32B 27/02

[58] Field of Search ..... 428/364, 373, 374, 375, 428/392, 394, 395, 359, 360; 57/140 BY, 157 F, 157 TS

[56] References Cited

UNITED STATES PATENTS

| | | | |
|---|---|---|---|
| 2,521,055 | 9/1950 | Foster | 139/420 |
| 3,083,523 | 4/1963 | Dahlstrom et al. | 428/364 |
| 3,512,232 | 5/1970 | Bolinger | 57/140 X |
| 3,616,167 | 10/1971 | Gosden | 57/140 BY X |
| 3,639,195 | 2/1972 | Sanders | 156/62.2 |

*Primary Examiner*—Lorraine T. Kendell
*Attorney, Agent, or Firm*—Cushman, Darby & Cushman

[57] ABSTRACT

A compact yarn of staple fibers containing at least a proportion of potentially adhesive fibers bonded to contacting fibers. The compact yarn may be made by false twisting a sliver of the staple fibers by means of a fluid vortex followed by activating the potentially adhesive fibers.

12 Claims, 2 Drawing Figures

Figure 1:
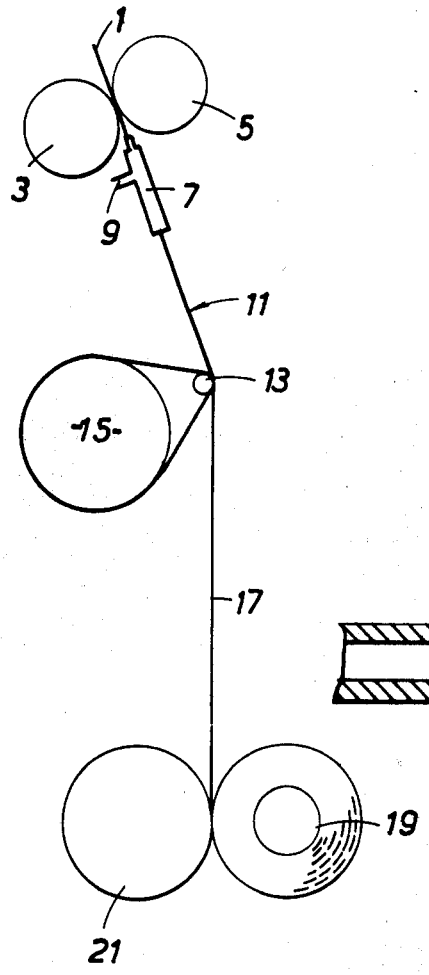

COMPACT TWISTLESS TEXTILE YARN COMPRISING DISCONTINUOUS FIBER BONDED BY POTENTIALLY ADHESIVE COMPOSITE FIBERS

This is a continuation of Application Ser. No. 357,576, now abandoned, filed May 7, 1973 as a division of Ser. No. 141,713 filed May 10, 1971, now U.S. Pat. No. 3,745,757.

This invention concerns improvements in or relating to the production of compact yarns and tows from discontinuous fibres.

By a "compact yarn" we mean that the fibres are bound together such that the yarn is manipulatable as an entity.

Conventionally, bundles of stable fibres have been rendered compact by the insertion of a high level of twist. The capabilities of twist-inserting agencies have limited the rate of yarn production and it has long been recognised that there are advantages of productivity to be gained from the use of substantially twistless yarns provided these can be handled in subsequent textile processes such as weaving. In addition, substantially twistless yarns can add structure and textural characteristics to fabrics. Further, in fabrics knitted or woven from conventional staple fibre yarns, fibres are pulled out from the surface and often tend to form small balls on the surface of the fabric, this effect is referred to as "pilling." The compact yarns of the present invention show a reduced tendency to pilling.

Accordingly, the present invention provides a compact yarn comprising an essentially parallel assembly of discontinuous fibres, consisting of at least a proportion of potentially adhesive fibres, said adhesive fibres being bonded to contacting fibres such that the bonded yarn has an average stripping force as defined of at least 1.0 g, a tenacity of at least 0.5 g/dtex and a yarn stiffness as defined of less than 0.005.

The present invention also provides a process for producing a compact yarn comprising false-twisting a sliver of discontinuous fibres, consisting of at least a proportion of potentially adhesive fibres, and subsequently activating the potentially adhesive fibres so as to bond them to contacting fibres.

By a "sliver" we mean an essentially parallel assembly of fibres substantially without twist.

Stripping force is defined as the force required to remove a single fibre from a bonded yarn and is measured by clamping one end of the yarn in the top jaws of an Instron Tensile Tester and a free fibre end, teased from the yarn, in the lower jaws which are then lowered at a rate of 5 cm/min. The force, in grams, to break or withdraw the fibre from the yarn is the stripping force. The average of 10 tests is taken.

Yarn stiffness is defined as follows:

A circular loop of the yarn 6.2 cms in diameter is hung on a horizontal cylindrical pin 0.64 cms in diameter. A weight of 0.05 g is suspended from the bottom of loop, and the maximum horizontal diameter of the resulting deformed loop (D cms) is measured. The linear density of the yarn is measured in Tex ($\Delta$). The yarn stiffness, X, is calculated where $X = D - 0.64/\Delta 2$. It is preferred that the bonded yarn has an average stripping force of at least 3.0 g. It is further preferred that the bonded yarn has a yarn stiffness less than 0.003.

Activation of the potentially adhesive fibres, i.e. rendering the fibres temporarily adhesive, may be achieved by heat or by chemical treatment depending on the nature of the fibres.

In one embodiment of the invention, activation of the potentially adhesive fibres is carried out intermittently, for example, by wrapping the sliver of discontinuous fibres around a heated grooved roll. Activation may also be achieved by using a heated fluid such as, for example, air or steam.

The discontinuous fibres may consist wholly of potentially adhesive composite fibres or alternatively may comprise a mixture of non-adhesive fibres and potentially adhesive homofibres or composite fibres.

The composite fibres must contain a potentially adhesive component, i.e. a component capable of being rendered temporarily adhesive. The components of the composite fibre may be arranged side-by-side or one component may be completely surrounded by another component, i.e. in a sheath and core relationship with, for example, the component forming the sheath being the potentially adhesive component, or the composite fibre may be of non-circular form, for example, trilobal with one or more of the lobes being formed at least in part by the potentially adhesive component. Examples of suitable composite fibres are poly(epsilon caprolactum)/poly(hexamethylene adipamide) fibres, poly(ethylene terephthalate-ethylene adipate)/poly(ethylene terephthalate), poly(ethylene terephthalate-ethylene isophthalate)/poly(ethylene terephthalate) fibres, the first mentioned component being the potentially adhesive component.

Examples of potentially adhesive homofibres which may be employed in admixture with non-adhesive fibres are poly(epsilon caprolactam) and polypropylene fibres.

By "non-adhesive fibres" is meant fibres which are not rendered adhesive by the activation treatment. The non-adhesive fibres may comprise synthetic fibres such as, for example, poly(ethylene terephthalate), poly(hexamethylene adipamide) or polyacrylonitrile fibres or natural fibres or may comprise a mixture of fibres.

The mixture of non-adhesive fibres and potentially adhesive fibres may be obtained by any known blending technique. It is preferred that the potentially adhesive fibres comprise 5% to 25% by weight on the weight of the mixture of fibres.

The sliver is preferably false-twisted by means of a fluid vortex and it is further preferred that the sliver be heated during its passage through the vortex by supplying fluid at an elevated temperature.

Figure 2:
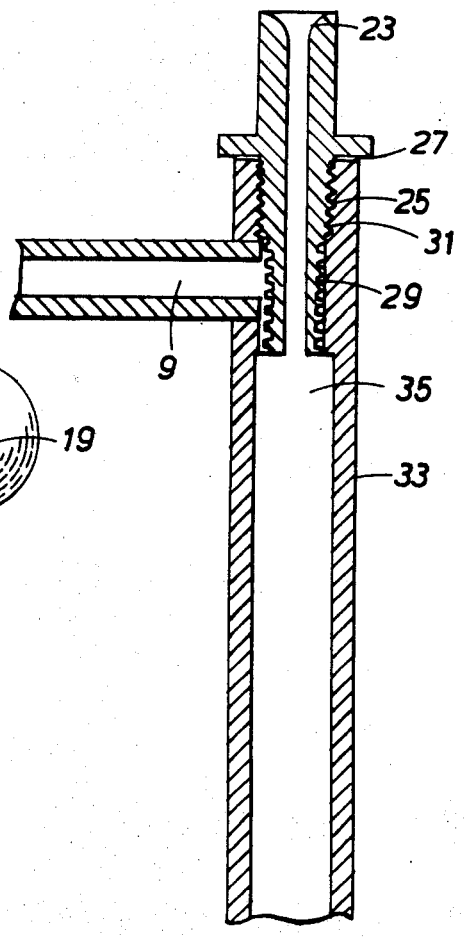

One embodiment of the invention will now be described with reference to the accompanying drawings, in which FIG. 1 is a schematic side view of one embodiment of the process of the invention FIG. 2 is a sectional view of the fluid vortex jet shown in FIG. 1.

Referring to FIG. 1, there is shown a sliver 1 of staple fibres containing potentially adhesive fibres passing through the front rolls 3,5 of a conventional apron drafting system. The drafted sliver is sucked into a fluid vortex jet 7 supplied with heated air via inlet tube 9. The fluid jet twists the sliver into yarn in the region between the vortex jet 7 and the nip of the drafting rolls 3,5. The length of this region is less than the length of the staple fibres comprising sliver 1.

Subsequent to passing through fluid jet 7, the yarn 11 is in an unbonded condition. The yarn 11 is bonded by passing it several times around a heated roll 15 and a separator roll 13. The bonded yarn 17, after it has cooled, is subsequently wound up on a cheese 19 which is surface driven by drive roll 21.

The fluid vortex jet 7 is shown in detail in FIG. 2. It comprises an insert member 25 and a body member 33. The insert member 25 has an annular passage, providing an induction end 23, a locating shoulder 27 and a helical thread 29. The body member 33 has an annular passage 35 and is provided with a fluid inlet tube 9. The insert member 25 and the body member 33 are threadably joined at 31 and located by means of shoulder 27.

In operation, fluid is forced into the jet via inlet tube 9. The fluid impinges on helical thread 29 with the result that a fluid vortex is established in passage 35. Drafted sliver is sucked into the jet via induction end 23 and is twisted in passage 35 by means of the fluid vortex.

The invention is illustrated but not limited by the following examples in which parts and percentages are by weight:

EXAMPLE 1

This illustrates the preparation of a compact yarn from a blend of poly(epsilon caprolactam) (nylon 6) fibres and poly(hexamethylene adipamide) (nylon 6.6) fibres.

3 parts of 2.1 dtex d.p.f., 1.4 inches long nylon 6 fibres and 7 parts of 1.7 dtex d.p.f., 1.5 inches long nylon 6.6 fibres were blended by carding three times and drafting twice to give a sliver.

The sliver was drafted on a conventional two stage apron draft with a total nominal draft of 26. The front rolls, rotating at a circumferential speed of approximately 100 f.p.m. After passing three times over the hot roll and an associated separator roll, the yarn was wound up on a cheese at approximately 100 f.p.m.

The air vortex tube was 3½ inches long, the insert was 1¼ inches long and 1.3/16 inch diameter, with a tubular passageway of 1/16 inch diameter bore down the centre. The helical thread on the outside of the insert was 3/16 inch long, measured along a line parallel to the axes of the insert. The clearance between the threaded portion of the insert and tube in which it is inserted was 0.001 inches.

It was supplied with 14 liters of air per minute at a pressure of 17 p.s.i. and a temperature of 155°C.

The surface of the hot roll had axially extending grooves ¼ inch wide separated by lands ½ inch wide cut across half the width of the roll. The yarn was heated by wrapping it once around the smooth part of the roll and segmentally bonded by wrapping it twice around the landed part of the roll. The hot roll temperature was approximately 250°C.

A compact yarn with the following properties was obtained: denier 432, tenacity 1.5 g.p.d. and extensibility 15%.

EXAMPLE 2

A sliver was made as in Example 1 from a blend of 70% of 3.3 dtex d.p.f., 1¼ inches long poly(ethylene terephthalate) staple fibres and 30% of 3.3 dtex d.p.f., 1¼ inches long sheath-core composite fibres having a core to sheath weight ratio of 2 to 1. The core comprised poly(ethylene terephthalate) and the sheath comprised a copolymer consisting of 80% of ethylene terephthalate units and 20% of ethylene isophthalate units.

The sliver was drafted at a draft of 25, compacted in a fluid vortex tube by air fed at 15 liters per minute at a temperature of 150°C and then bonded by wrapping it 3 times around the grooved part of a heated grooved roll and associated separator roll as in Example 1. The heated roll had a surface temperature of 250°C.

A compact yarn having the following properties was obtained: denier 444, tenacity 1.6 g.p.d., extensibility 17.5% and initial modulus 26 g.p.d.

EXAMPLE 3

Three slivers were made from blends of fibres containing respectively, 80%; 90%; 95% of 3.3 dtex per filament 38 mm polyethylene terephthalate fibres; and 20%, 10% and 5% of a bicomponent fibre with a core of polyethylene terephthalate and a sheath of a copolymer comprising 20 mole % polyethylene adipate and 80% polyethylene terephthalate. The weight ratio of core to sheath was 2 to 1. These slivers were drafted 20 times to give a yarn of 20's cotton count at 100' per minute, compacted in a fluid vortex tube as in Example 1 and bonded by wrapping seven times round a separator roll and hot roll, with a surface temperature of about 265°C. The resulting yarns had tenacities of 1.5; 1.1½ 0.3 g/dtex respectively, average stripping forces of 8.3, 10.2 and 3.9 g respectively and yarn stiffnesses of 0.0032, 0.0044 and 0.0019 respectively.

EXAMPLE 4

A sliver was made from 3.3 dtex per filament 38 mm long core sheath bicomponent fibres. The core was made of 6.6 nylon and the sheath of 6 nylon. The weight ratio of core to sheath was 2 to 1. The sliver was drafter and compacted as in Example 1 and then bonded by wrapping once round the smooth part of the heated roll and twice round the grooved part. The peripheral speed of the hot roll was 100'/min and the surface temperature about 240°C. A compact yarn of following properties was obtained: Linear density 390 dtex, tenacity 1.4 g per dtex, extensibility 20%, initial modulus 7 g per dtex, average stripping force 7.3 g and yarn stiffness 0.0011.

EXAMPLE 5

A roving of 2 cotton count was made by conventional means from a blend of fibres comprising 30% cotton, 30% nylon 6.6 38 mm long 1.7 dtex, 40% bicomponent fibre with nylon 6.6 core and nylon 6 sheath 38 mm long 3.3 dtex. The weight ratio of core to sheath was 2 to 1. The roving was drafted approximately 20 times with the front rollers of the drafting system running at 300' per minute. After compacting in an air vortex false twister as in Example 1, the yarn was bonded by passing 8 times round a heated roll with a surface temperature about 265°C. The yarn had an average stripping force of 1.2 g, a yarn stiffness of 0.0006 and a tenacity of 0.9 g/dtex. The yarn was woven into fabric which was of good even appearance and which showed good resistance to pilling.

EXAMPLE 6

A sliver was made from a blend of 50% nylon 6.6 and 50% of a side/side bicomponent fibre of nylon 6 and nylon 6.6. The sliver was drafted to 200 dtex yarn at 100'/min, compacted in an air vortex as in Example 1 and bonded by means of a heated roll with surface temperatures of 250°C. The resulting yarn had a tenacity of 1.3 g/dtex.

EXAMPLE 7

A blend comprising 60% polyester terephthalate and 40% of a 2:1 by weight core:sheath bicomponent fibre with polyethylene terephthalate core and a copolymer of 80% polyethylene terephthalate 20% polyethylene isophthalate as sheath, was made into a sliver and drafted 25 times at 100'/min and then compacted in an air vortex false twister as in Example 1. Part of the yarn was bonded by passing over a partly grooved hot roll (½ inch wide grooves separated by 1/32 inch wide lands for half the width of the surface) one wrap on the ungrooved part of the roll and one wrap on the grooved part. This yarn had a tenacity of 1.7 g/dtex and an initial modulus of 43 g/dtex. A further part of the yarn was wrapped three times on the grooved part of the roll, this yarn also had a tenacity of 1.7 g/dtex but the initial modulus was 30 g/dtex and the yarn had a much softer hand than the first yarn.

EXAMPLE 8

A roving comprising 70% 1.7 dtex 38 mm polyethylene terephthalate fibres and 30% of the bicomponent fibre used in Example 7 was drafted to 158 dtex at 300'/min and passed into an air vortex. Air was supplied to the vortex at pressures of 20, 40 and 60 p.s.i. and at temperatures from 90°C to 260°C. On leaving the vortex the yarns were bonded with 5 wraps round a heated roll at about 260°C. There was little difference in the properties of the yarn with changes in vortex conditions. At pressures below 20 p.s.i. there was insufficient suck for fibres to enter the vortex. The yarns had average stripping forces of 4.8 g, and yarn stiffnesses of 0.0043. and tenacities of 1.5 g/dtex.

EXAMPLE 9

A roving of 2 cotton count linear density was prepared by conventional means. This roving contained 33% by weight cotton fibres, 37% 1.7 dtex 38 mm polyethylene terephthalate fibres and 30% 3.3 dtex 38 mm bicomponent core-sheath (weight ratio 2:1) fibre with polyethylene terephthalate core and 20% polyethylene isophthalate 80% polyethylene terephthalate sheath. The roving was drafted to a nominal draft of 20. The front rolls of the drafting machine were rotating at about 160 inches per minute surface speed. After the tissue of fibres was compacted in an air vortex supplied with air at 175°C, the yarn was passed over the heated grooved roll and associated separate roll of Example 7, one wrap round the smooth part of the roll and three round the grooved part. The surface temperature of the roll was at about 250°C. The bonded yarn was wound up on a surface driven tube at about 155 inches per minute.

The yarn had an average stripping force of 4.1 g, (4.0 g after boiling in water), a yarn stiffness of 0.0023, an average linear density of 37½ cotton count, tenacity of 0.91 g/dtex (unchanged after boiling in water) and extensibility of 8.7%, and was subsequently woven into a plain weave fabric having 112 ends per inch and 68 picks/inch. This fabric was of good appearance, and had better covering power than a similar fabric woven from a 33% cotton 67% polyethylene terephthalate ring spun yarn of similar count. The pilling propensity of the fabrics were compared using the following pilling test:

4 samples, 4½ inches × 5½ inches in size, of each fabric were wrapped round rubber tubes about 1 inch in diameter and 6½ inches long. The samples were tumbled in a cuboid shaped box of about 9 inches side length, lined with cork, for a period of 5 hours. The samples were inspected at intervals and any occurrence of pilling noted.

The fabric from yarn produced according to the present invention pilled less than the fabric from the ring spun yarn.

EXAMPLE 10

A roving containing 30% of the bicomponent fibre used in Example 9 and 70% of 3.3 dtex 38 mm polyethylene terephthalate was drafted and the issuing tissue of fibres compacted in the air vortex fed with air at a temperature of 200°C, the unbonded yarn was wound up at 200 inches per min.

A package of this yarn was placed in a circulating air oven whose temperature was controlled at 215°C. The yarn was removed 30 minutes later and when tested had a tenacity of 1.4 g/dtex, an average stripping force of 8.9 g and a yarn stiffness of 0.0090; before placing in the oven the yarn had been too weak to test.

EXAMPLE 11

A double sided hot plate 25 mm wide and 160 mm long and 18½ mm thick was made. At each end of this plate rollers of 19 mm diameter were mounted and provided with rotating means. Yarns could be passed several times round the plate, and roller without the main bulk of the yarn being in contact with the plate. A roving similar to that in Example 10 except the polyethylene terephthalate was of 1.7 dtex was drafted at 100 inches/min and compacted in an air vortex, the yarn was then wrapped 5 times round the hot plate roller system described above with the rollers driven at 100 inches/min surface speed. The temperatures of the hot plate varied from about 250°C to 270°C along its length. The resulting yarn had a tenacity of 1.7 g/dtex, an average stripping force of 7.3 g and a yarn stiffness of 0.0085.

EXAMPLE 12

A yarn was made as in Example 9 except that the fibre blend contained 67% of the bicomponent fibre and no polyethylene terephthalate fibre. The yarn had an average stripping force of 3.2 g, a tenacity of 1.0 g/dtex and a yarn stiffness of 0.0076. The yarn was woven in the same way as in Example 9 but the resulting fabric had a harsh, papery handle.

I claim:

1. A compact yarn comprising an assembly of discontinuous fibres, substantially free of continuous twist consisting of at least a proportion of potentially adhesive composite fibres selected from the group consisting of polyamide fibres and polyester fibres, said composite fibres comprising two components one of which is potentially adhesive and forms at least part of the surface of the composite fibres, said composite fibres being bonded by means of said potentially adhesive component to contacting fibres such that the bonded yarn has a linear density of up to 33 tex, an average stripping force as defined of at least 1.0g, a tenacity of at least 0.5g/dtex and a yarn stiffness as defined of less than 0.005.

2. A compact yarn according to claim 1 in which the yarn has an average stripping force of at least 3.0g.

3. A compact yarn according to claim 1 in which the discontinuous fibres consist wholly of potentially adhesive composite fibres.

4. A compact yarn according to claim 1 in which the discontinuous fibres comprise a mixture of non-adhesive fibres and potentially adhesive composite fibres.

5. A compact yarn according to claim 4 in which the potentially adhesive composite fibres comprise 5% to 25% by weight on the weight of the mixture of fibres.

6. A compact yarn as in claim 1 wherein the non-adhesive fibres are selected from the group consisting of polyethylene terephthalate fibres, polyhexamethylene adipamide fibres, polyacrylonitrile fibres, natural fibres or mixtures thereof.

7. A compact yarn comprising an assembly of discontinuous fibres, substantially free of continuous twist consisting of at least a proportion of potentially adhesive composite fibres selected from the group consisting of polyamide fibres and polyester fibres, said composite fibres comprising two components one of which is potentially adhesive and forms at least part of the surface of the composite fibres, said composite fibres being bonded by means of said potentially adhesive component to contacting fibres such that the bonded yarn has a linear density of up to 43 tex, an average stripping force as defined of at least 1.0g, a tenacity of at least 0.5g/dtex and a yarn stiffness as defined of less than 0.003.

8. A compact yarn according to claim 7 in which the yarn has an average stripping force of at least 3.0g.

9. A compact yarn according to claim 7 in which the discontinuous fibres consist wholly of potentially adhesive composite fibres.

10. A compact yarn according to claim 7 in which the discontinuous fibres comprise a mixture of non-adhesive fibres and potentially adhesive composite fibres.

11. A compact yarn according to claim 10 in which the potentially adhesive composite fibres comprise 5% to 25% by weight on the weight of the mixture of fibres.

12. A compact yarn as in claim 7 wherein the non-adhesive fibres are selected from the group consisting of polyethylene terephthalate fibres, polyhexamethylene adipamide fibres, polyacrylonitrile fibres, natural fibres or mixtures thereof.

* * * * *